US010735873B2

(12) United States Patent
Adel et al.

(10) Patent No.: US 10,735,873 B2
(45) Date of Patent: Aug. 4, 2020

(54) HEARING AID APPARATUS AND HEARING AID DEVICE

(71) Applicant: SIVANTOS PTE. LTD., Singapore (SG)

(72) Inventors: Hans Adel, Stein (DE); Birgit Kuefner-Schwerdtner, Erlangen (DE); Juergen Reithinger, Neunkirchen am Brand (DE); Benjamin Schmidt, Roethenbach an der Pegnitz (DE); Erwin Singer, Eckental (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/264,916

(22) Filed: Feb. 1, 2019

(65) Prior Publication Data

US 2019/0166437 A1 May 30, 2019

Related U.S. Application Data

(63) Continuation of application No. PCT/EP2017/058440, filed on Apr. 7, 2017.

(30) Foreign Application Priority Data

Aug. 1, 2016 (EP) ..... 16182230

(51) Int. Cl.
*H04R 25/00* (2006.01)

(52) U.S. Cl.
CPC ..... *H04R 25/554* (2013.01); *H04R 25/602* (2013.01); *H04R 25/65* (2013.01); *H04R 2225/51* (2013.01); *H04R 2460/17* (2013.01)

(58) Field of Classification Search
CPC .... H04R 25/554; H04R 25/602; H04R 25/65; H04R 25/652; H04R 2225/51; H04R 2460/17
See application file for complete search history.

(56) References Cited

U.S. PATENT DOCUMENTS

| | | | | |
|---|---|---|---|---|
| 5,721,783 | A | 2/1998 | Anderson | |
| 2005/0168396 | A1 | 8/2005 | Victorian et al. | |
| 2010/0020994 | A1* | 1/2010 | Christensen | H04R 25/554 381/315 |
| 2014/0023216 | A1* | 1/2014 | Solum | H04R 25/554 381/315 |
| 2015/0289067 | A1 | 10/2015 | Riepenhoff | |
| 2016/0381470 | A1* | 12/2016 | Henriksen | H01Q 1/273 381/315 |

FOREIGN PATENT DOCUMENTS

DE 69637454 T2 3/2009

* cited by examiner

*Primary Examiner* — Sunita Joshi
(74) *Attorney, Agent, or Firm* — Laurence A. Greenberg; Werner H. Stemer; Ralph E. Locher

(57) ABSTRACT

A hearing aid apparatus contains a housing having a housing face. The housing face is directed outwardly when the hearing aid apparatus is being worn. The hearing aid apparatus further has an antenna and a transmitter and/or receiver for electromagnetic waves disposed in the housing. The transmitter and/or receiver is coupled to the antenna element. A grip element is disposed on the housing face of the housing, and the antenna is integrated at least in part in the grip element.

11 Claims, 3 Drawing Sheets

HEARING AID APPARATUS AND HEARING AID DEVICE

CROSS-REFERENCE TO RELATED APPLICATION

This is a continuation application, under 35 U.S.C. § 120, of copending international application No. PCT/EP2017/058440, filed Apr. 7, 2017, which designated the United States; this application also claims the priority, under 35 U.S.C. § 119, of European patent application No. EP 16 182 230.9, filed Aug. 1, 2016; the prior applications are herewith incorporated by reference in their entireties.

BACKGROUND OF THE INVENTION

Field of the Invention

The invention relates to a hearing aid apparatus, in particular an in-the-ear hearing apparatus, with a housing having a transmitting and/or receiving unit for electromagnetic waves arranged therein, which unit is coupled to an antenna element. The invention also relates to an in particular binaural hearing aid device containing two hearing apparatuses of this kind.

Hearing aid apparatuses are portable hearing apparatuses which are used to treat those who are hard of hearing or those with impaired hearing. In order to satisfy the many individual requirements, different designs of hearing aid apparatuses are provided, such as behind-the-ear (BTE) hearing apparatuses and hearing apparatuses with an external receiver (RIC: receiver in the canal) and in-the-ear (ITE) hearing apparatuses, for example also concha hearing apparatuses or channel hearing apparatuses (ITE: In-The-Ear, CIC: Completely-In-Channel, IIC: Invisible-In-The-Channel), The hearing apparatuses stated by way of example are worn on the outer ear or in the ear passage of a hearing aid apparatus user. In addition, bone conduction hearing aids and implantable or vibrotactile hearing aids are also available on the market. The damaged hearing is stimulated here either echanically or electrically.

Hearing aid apparatuses or hearing apparatuses of this kind have in principle an amplifier and an output transducer as essential (hearing apparatus) components. The input transducer is generally an acousto-electrical transducer, such as a microphone, and/or an electromagnetic receiver, for example an induction coil or a (radio frequency, RF) antenna. The output transducer is usually provided as an electro-acoustic transducer, for example as a miniature loudspeaker (receiver), or as an electromechanical transducer, such as a bone conduction receiver. The amplifier is usually integrated in a signal processing unit. The energy supply is usually provided by a battery or a rechargeable accumulator.

Hearing apparatuses of this kind also have, for example, an antenna element as RF antenna, by which the hearing apparatus can be coupled for signal exchange for example to a control element (remote control) and/or to a further hearing apparatus. For space reasons the same antenna element is generally used to transmit and receive data.

In the case of what is known as a binaural hearing aid device, two hearing apparatuses or hearing aid apparatuses of this kind are worn by a user, wherein during operation a wireless signal connection exists between the antenna elements of the hearing apparatuses. During operation, data, possibly also large volumes of data, are exchanged or transmitted wirelessly between the hearing apparatuses on the right and left ear. The exchanged data and information make it possible to adapt the hearing apparatuses particularly effectively to the particular acoustic situation. In particular a particularly authentic ambient sound is hereby made possible for the user, and the speech comprehension is improved, also in loud surroundings.

Hearing apparatuses are preferably made to be particularly space-saving and compact, such that they can be worn so as to be visually as inconspicuous as possible to the hearing apparatus user, Increasingly smaller hearing apparatuses are thus produced, which have an increasingly greater level of wearing comfort and thus are hardly perceived by a user when they are worn on or in an ear. Due to the consequently reduced installation space, however, it is increasingly difficult to accommodate and/or to install conventional antenna elements for wireless signal transmission in hearing apparatuses of this kind.

This problem occurs in particular in the case of ITE hearing apparatuses, which are generally custom-made and sit deeply in the ear passage or ear canal of the hearing apparatus user. Such hearing apparatuses are preferably formed with a compact installation space in such a way that they are arranged so as to be substantially invisible when worn in the ear canal. For facilitated removal or in order to remove ITE hearing apparatuses from the ear canal, grip elements in the form of pull-out threads or loops are conceivable, which are fixedly coupled to the housing of the hearing apparatus and can be easily grasped by a hearing apparatus user. Grip elements of this kind are generally arranged on a housing face that is an outer face in the worn state, for example a faceplate of the housing, such that they can be easily grasped by a hearing apparatus user as required. The pull-out threads and loops are usually used here merely for the purpose of pulling out the ITE hearing apparatus from the ear in a simplified manner.

SUMMARY OF THE INVENTION

The object of the invention is to describe a particularly suitable hearing aid apparatus. The further object of the invention is to describe a hearing aid device equipped with two hearing aid apparatuses of this kind.

With regard to the hearing aid apparatus the object is achieved according to the invention by the features of the first independent claim, and with regard to the hearing aid device it is achieved according to the invention by the features of the second independent claim. Advantageous embodiments and developments are the subject of the various dependent claims.

The hearing aid apparatus according to the invention is embodied in particular as an in-the-ear (ITE) hearing apparatus, for example as a channel hearing apparatus (ITE: In-The-Ear, CIC: Completely-In-Channel, IIC: Invisible-In-The-Channel). The hearing aid apparatus, also referred to hereinafter as a hearing apparatus, has a shell-like housing for receiving electrical and electronic hearing apparatus components.

The hearing apparatus components comprise a transmitting and/or receiving unit for electromagnetic waves. Electromagnetic waves are understood hereinafter in particular to be radio signals, also referred to as RF signals. The transmitting and/or receiving unit is associated with an antenna element for sending and/or receiving the RF signals; this means that the transmitting and/or receiving unit is coupled to the antenna element at least for signal exchange.

A grip element (grip part) is arranged on a housing face of the housing that points outwardly when the apparatus is being worn, for example on a faceplate (covering, upper shell) closing the housing in a cover-like manner, the grip element being easily graspable in the worn state by a hearing aid apparatus user. The grip element is mechanically fixedly coupled to the housing and/or the housing face in a suitable way. The hearing aid apparatus thus can be easily pulled out or removed in the worn state by the grip element. In accordance with the invention it is provided here that the antenna element is integrated at least in part in the grip element. A particularly suitable hearing aid apparatus is provided by the functional integration of the antenna element and the grip element. Due to the at least partial arrangement of the antenna element outside the housing, the performance and efficacy thereof are also improved.

In contrast to the prior art, the grip element therefore serves not merely to pull out or remove the hearing aid apparatus from an ear passage or ear canal, but has a further function with regard to the operation of the hearing aid apparatus on account of the integrated antenna element. Due to the integration of the antenna element in the grip element, the antenna element is arranged at least partially outside the housing, whereby installation space inside the housing is saved. It is thus possible to design the hearing aid apparatus to have a more compact installation space, whereby on the one hand the wearing comfort of the hearing aid apparatus is increased. On the other hand the hearing aid apparatus thus can be inserted so as to be particularly visually inconspicuous within the ear canal (ear passage).

The housing of the hearing aid apparatus is preferably adapted individually to the ear canal or the ear passage of the (hearing aid apparatus) user. In other words, the housing is tailored to the user in question. Since the antenna element is arranged at least in part outside the housing, constructional limitations of the antenna element compared to a complete arrangement of the antenna element within the housing are avoided. This translates consequently and advantageously into additional freedoms with regard to the embodiment and design of the antenna element, and therefore a relatively large number of antenna structures is made possible for the hearing aid apparatus. Furthermore, greater freedoms in respect of a dimensioning of the antenna length are thus made possible.

The hearing aid apparatus contains, as hearing apparatus components, for example an input transducer and an amplifier as signal processing unit, and an output transducer. The transmitting and/or receiving unit is suitable and designed in terms of function to generate and/or evaluate RF signals that can be sent and received by means of the antenna element. The transmitting and/or receiving unit to this end for example has electronic component parts for adaptation to the antenna element, for example for power matching or impedance adaptation. The transmitting and/or receiving unit and the antenna element are together preferably formed as a transceiver, that is to say as a transmitting receiver or a transmitting and receiving unit, of the hearing aid apparatus, for wirelessly transmitting and receiving (radio) signals and data.

The transmitter range of the transceiver unit is for example 10 m. A range is understood here in particular to mean the signal range, that is to say the distance of the particular communication or signal connection that can exist maximally between a transmitter and a receiver so that communication therebetween is still possible.

The antenna element is preferably formed as a radio frequency antenna (RF antenna) or as an RF resonator, for example for a 2.4 GHz Bluetooth transmission by an ISM frequency band (ISM: Industrial, Scientific and Medical). The antenna element is thus suitable and designed to receive or pick up and to send or emit electromagnetic radio waves.

When worn, the hearing aid apparatus is preferably substantially completely, but at least partially arranged in an ear canal or ear passage of the user. The antenna element and/or the transmitting and/or receiving unit are preferably suitable and configured here for the correction of attenuations and/or detuning of the RF signals caused by the user's head.

The grip element is for example stirrup-like or loop-like. In an advantageous embodiment, however, the grip element is formed for example as an elongate pull-out thread (pull-off string), which protrudes approximately perpendicularly from the housing face or faceplate. As a result of the approximately perpendicular orientation of the antenna element, a particularly suitable orientation and positioning is provided in the wearing state, whereby radiation losses caused by attenuations and/or detuning of the RF signals by the user's head are advantageously reduced. This consequently transfers in particular advantageously to the signal quality of a wireless signal connection in a binaural design of the hearing aid apparatuses.

In a constructionally simple development the antenna element is embodied as a wire integrated in the grip element, in particular in the pull-out thread. The wire extends here in particular along a longitudinal direction of the grip element. A particularly economical hearing aid apparatus is thus made possible.

The antenna element can be embodied here for example as a monopole antenna, wherein the length of the antenna element can be adapted accordingly to the wavelength of the RF signals to be sent and/or to be received.

In an expedient embodiment the grip element is produced at least in part from an electrically non-conductive material. In other words, the antenna element does not extend over the entire length of the pull-out thread. This is advantageous in particular in an embodiment of the antenna element as a monopole antenna, since the length of the pull-out thread typically required is greater than the desired antenna length for receiving the RF signals.

In a conceivable design the antenna element is embodied as a dipole antenna with a first dipole arm integrated in the grip element and with a second dipole arm arranged in the housing. In this regard, it is conceivable for example for the second dipole arm to be integrated in the housing face or faceplate of the housing. An expedient antenna element for the hearing aid apparatus is thus provided.

The first and second dipole arms of the antenna element are expediently arranged substantially perpendicularly to one another in a suitable embodiment. This is desirable in particular with integration of the second dipole arm in the housing face.

In an alternative embodiment the antenna element is embodied as an F-shaped antenna with a transmitting and/or receiving region integrated in the grip element embodied as a vertical F limb, to which two contact arms inside the housing are coupled as horizontal F limbs. The antenna element is formed here in particular as an inverted F antenna. A particularly advantageous antenna structure is thus provided for the antenna element integrated in the grip element. An H-shaped embodiment (H antenna) is also conceivable, for example.

An additional or further aspect of the invention provides that the antenna element is coupled to a battery inside the housing, in particular by means of at least one contact arm. The battery is received here for example in a battery compartment of the housing. As a result of the coupling, the battery is substantially incorporated in the antenna element.

The battery here suitably forms a counterweight (opposite pole) or a mass relative to an antenna element formed for example as a monopole or F antenna. A particularly expedient counterweight of the antenna element with compact installation space is thus made possible.

Additionally or alternatively, it is also conceivable for the antenna element to be coupled to a metallized housing face of the housing, in particular by means of at least one contact arm. The housing face is in this case in particular a housing inner wall of the housing, which is metallized at least in part or in regions, and therefore can be used as a ground plane within the housing for contacting the antenna element. This metallization thus increases the available ground plane of the ground potential within the housing, and therefore the counterweight of the antenna element.

In a preferred application two hearing aid apparatuses according to the invention are used for an in particular binaural hearing aid device. The hearing aid apparatuses during operation are wirelessly connected by means of the antenna elements thereof for signal exchange. In other words, a signal or communication connection is produced between the hearing aid apparatuses for wireless signal transmission. The respective antenna elements act here both as transmitting and receiving antennas.

Other features which are considered as characteristic for the invention are set forth in the appended claims.

Although the invention is illustrated and described herein as embodied in a hearing aid apparatus and a hearing aid device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts and dimensions corresponding to one another are always provided in all figures with the same reference signs.

Figure 1:
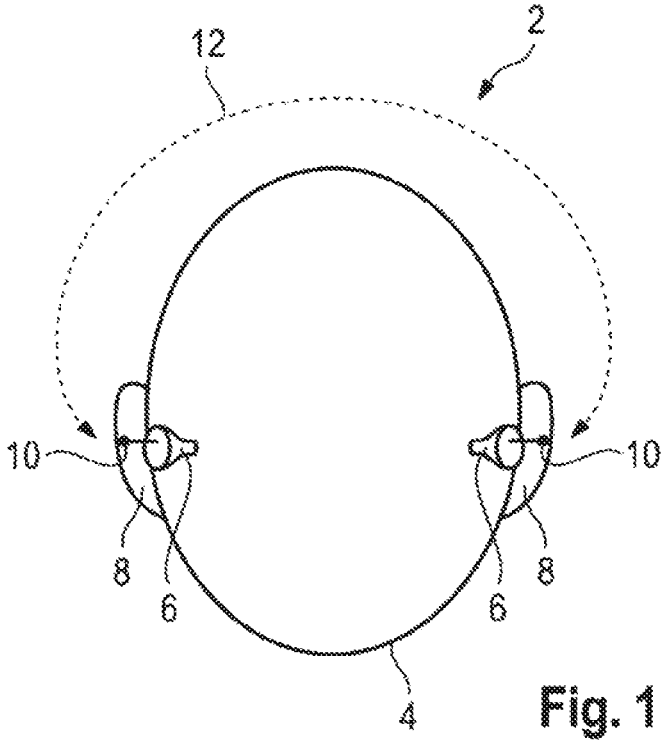
FIG. 1 is an illustration of a binaural hearing aid device having two hearing aid apparatuses in a worn state.

Referring now to the figures of the drawings in detail and first, particularly to FIG. 1 thereof, there is shown a binaural hearing aid device 2 is shown schematically in FIG. 1 in a state worn on a user's head 4. The hearing aid device 2 contains two hearing aid apparatuses 6, which in the worn state sit substantially completely within an ear canal or ear passage (not shown in greater detail) of a left and right ear 8 respectively. The hearing aid apparatuses 6 each have an antenna element 10, by which the hearing aid apparatuses 6 during operation are coupled for bidirectional signal exchange by a wireless radio or signal connection 12.

Figure 2:
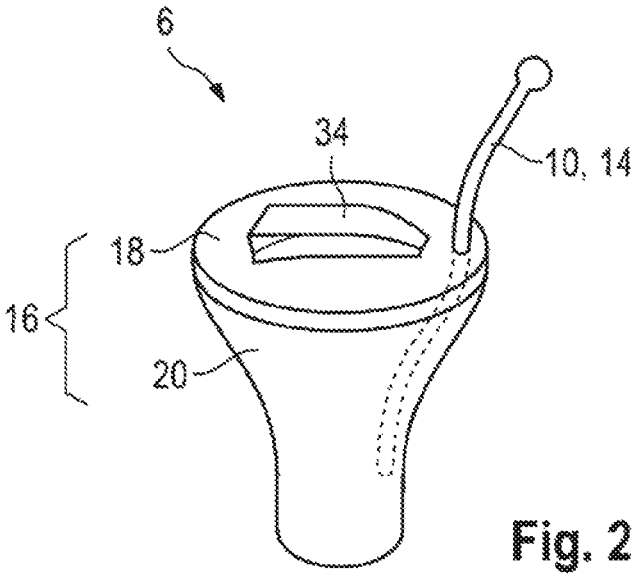
FIG. 2 is a perspective view of one of the hearing aid apparatuses with a combined grip element and antenna element.

The hearing aid apparatus 6 shown individually in FIG. 2 has an elongate grip element 14 in the form of a pull-out thread for facilitated removal or for pulling out the apparatus from the ear canal. The grip element 14 is in this case coupled mechanically fixedly to a housing 16 of the hearing aid apparatus 6. For simplified grasping by the user, the grip element 14 is arranged on a housing face 18, in particular a faceplate, of the housing 16, which face is arranged on the outer side when the apparatus is being worn. In accordance with the invention the antenna element 10 is integrated here at least in part in the grip element 14 or is formed integrally therewith. In other words, the grip element and the antenna element 10 are embodied as a common component part. The antenna element 10 thus extends at least partially outside the housing 16 and protrudes approximately perpendicularly therefrom, in particular in the region of the faceplate 18.

Figure 3:
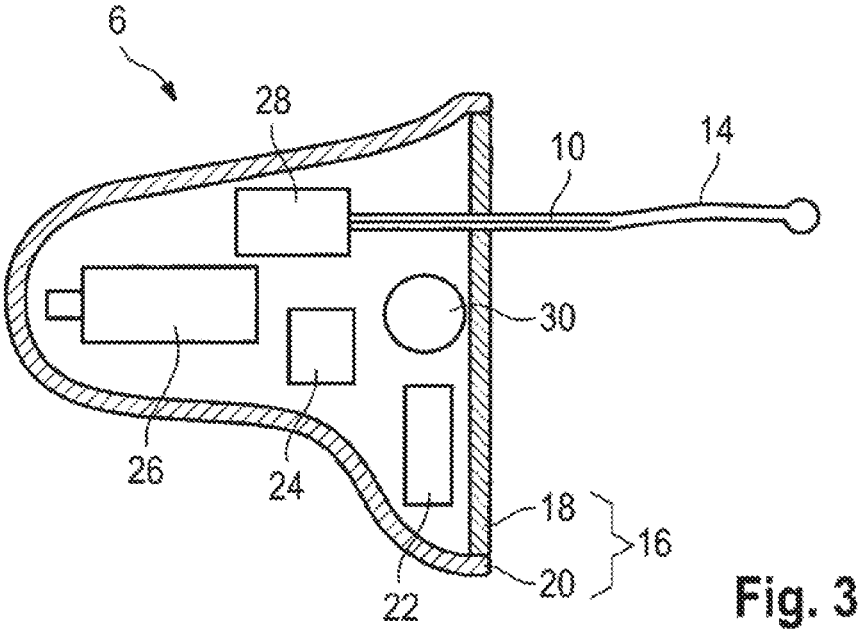
FIG. 3 is a sectional view of the hearing aid apparatus with an antenna element formed as a monopole antenna.

The hearing aid apparatus 6 shown schematically in section in FIG. 3 is embodied as an ITE hearing apparatus. The hearing aid apparatus 6 contains a housing shell 20, which is adapted individually to the ear passage of the hearing apparatus user and which is closed by means of the cover-like faceplate 18. In the housing 16 of the hearing aid apparatus 6 formed by the housing shell 20 and the faceplate 18, there are arranged hearing apparatus components in the form of a microphone 22, a signal processing unit 24, a receiver 26 and a transmitting and receiving unit 28 for electromagnetic waves. The hearing apparatus components are supplied with electrical energy by a battery 30.

The battery 30 in the assembled state is arranged suitably in a battery compartment 32 (FIG. 4) of the housing 16. The battery compartment 32 is closed by a cover-side flap 34 (FIG. 2).

In the exemplary embodiment shown in FIG. 3, the antenna element 10 is embodied as a wire integrated in the grip element 14 or as an integrated cable. The wire extends here in particular along a longitudinal direction of the grip element 14. A particularly economical hearing aid apparatus is thus made possible. The antenna element 10 is embodied here as a monopole antenna, the feed-side antenna end of which is guided on the transmitting and receiving unit 28. The opposite free end of the antenna element 10 is guided and integrated in the grip element 14.

In the assembled state the antenna element 10 is coupled in the form of a transceiver of the hearing aid apparatus 6 to the transmitting and receiving unit 28 for signal exchange and for example is suitable and designed for a wireless 2.4 GHz Bluetooth signal transmission in an ISM frequency band.

As can be seen relatively clearly in the sectional illustration of FIG. 3, the grip element 14 is manufactured at least in part from an electrically non-conductive material. In other words, the antenna element 10 does not extend over the entire length of the grip element 14.

Two further exemplary embodiments of the antenna element 10 will be explained in greater detail with reference to FIGS. 4 and 5.

Figure 4:
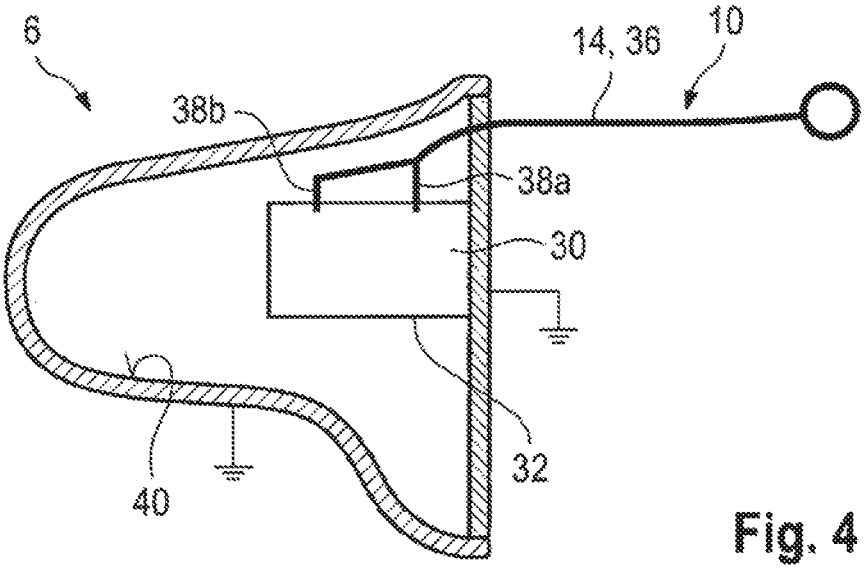
FIG. 4 is a sectional view of the hearing aid apparatus in a second embodiment with an antenna element formed as an inverted F antenna.

In the exemplary embodiment of FIG. 4, the antenna element 10 is embodied as an inverted F antenna. The hearing apparatus components 22, 24, 26 and 28 are not shown in greater detail in FIG. 4.

The antenna element 10 in this embodiment has a vertical F limb 36, which is formed as a transmitting and receiving region and which is integrated in the grip element 14. The transmitting and receiving region 36 in this case forms the grip element 14 itself in particular. In other words, the transmitting and receiving region 36 and the grip element 14 in this exemplary embodiment are embodied in particular monolithically, that is to say in one piece or integrally, with one another. The transmitting and receiving region 36 forms substantially the portion of the antenna element 10 outside the housing. On the housing inner side, that is to say inside the housing 16, the transmitting and receiving region 36 is guided at two contact arms within the housing in the form of horizontal F limbs 38*a*, 38*b*.

For example, the contact arm 38*a* is connected here as feed line to the transmitting and receiving unit 28 (not shown in FIG. 4), wherein the second contact arm 38*b* is guided as a short-circuit connection at a ground potential. In the exemplary embodiment shown in FIG. 4, the contact arm 38*b* to this end is coupled in particular to the battery 30 within the housing. As a result of the coupling, the battery 30 is substantially incorporated in the antenna element 10. The battery 30 here forms a counterweight (counterpole) or a ground to the antenna element 10 configured as an F antenna.

In an additional or alternative embodiment, it is conceivable for example for the antenna element 10, or the contact arm 38*b* thereof, to be coupled to a metallized housing face 40 of the housing 16. The housing face 40 is in this case in particular a housing inner wall of the housing which is metallized at least in part or in regions and therefore can be used as a ground plane within the housing for contacting the antenna element 10.

Figure 5:
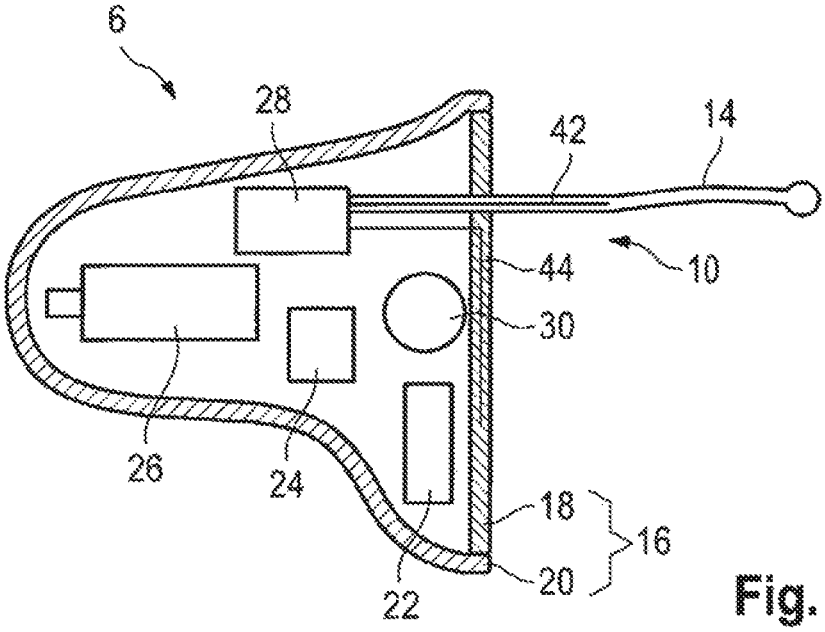
FIG. 5 is a sectional view of the hearing aid apparatus in a third embodiment with a dipole antenna as the antenna element.

In the exemplary embodiment of FIG. 5 the antenna element 10 is embodied as a dipole antenna with a first dipole arm 42 integrated in the grip element 14 and with a second dipole arm 44 arranged in the housing 16. The dipole arm 44 is integrated here in particular in the material of the faceplate 18. The dipole arms 42 and 44 of the antenna element 10 are arranged substantially perpendicularly to one another.

The invention is not limited to the above-described exemplary embodiments. Rather, other variants of the invention can also be derived herefrom by a person skilled in the art without departing from the subject matter of the invention. In particular, all individual features described in conjunction with the exemplary embodiments can furthermore also be combined with one another in other ways without departing from the subject matter of the invention.

The following is a summary list of reference numerals and the corresponding structure used in the above description of the invention:

| | |
|---|---|
| 2 | hearing aid device |
| 4 | head |
| 6 | hearing aid apparatus |
| 8 | ear |
| 10 | antenna element |
| 12 | signal connection |
| 14 | grip element |
| 16 | housing |
| 18 | housing face/faceplate |
| 20 | housing shell |
| 22 | microphone |
| 24 | signal processing unit |
| 26 | receiver |
| 28 | transmitting and receiving unit |
| 30 | battery |
| 32 | battery compartment |
| 34 | flap |

-continued

| | |
|---|---|
| 36 | F limb/transmitting and receiving region |
| 38a, 38b | F limb/contact arm |
| 40 | housing face |
| 42, 44 | dipole arm |

The invention claimed is:

1. A hearing aid apparatus, comprising:

a housing having a housing face, said housing face being directed outwardly when the hearing aid apparatus is being worn;

an antenna being an F-shaped antenna having two contact arms disposed inside said housing as horizontal F limbs;

a transmitter and/or receiver for electromagnetic waves and disposed in said housing, said transmitter and/or receiver coupled to said antenna;

a grip element disposed on said housing face of said housing, and said antenna is integrated at least in part in said grip element; and a transmitting and/or receiving region integrated in said grip element as a vertical F limb, said vertical F limb is coupled to said two contact arms.

2. The hearing aid apparatus according to claim 1, wherein said grip element is formed as a pull-out thread which protrudes approximately perpendicularly from said housing face.

3. The hearing aid apparatus according to claim 1, wherein said antenna is embodied as a wire integrated in said grip element.

4. The hearing aid apparatus according to claim 1, wherein said grip element is produced at least in part from an electrically non-conductive material.

5. A hearing aid apparatus, comprising:

a housing having a housing face, said housing face being directed outwardly when the hearing aid apparatus is being worn;

an antenna;

a transmitter and/or receiver for electromagnetic waves and disposed in said housing, said transmitter and/or receiver coupled to said antenna;

a grip element disposed on said housing face of said housing, and said antenna is integrated at least in part in said grip element; and said antenna being a dipole antenna having a first dipole arm integrated in said grip element and a second dipole arm disposed in said housing, said first and second dipole arms of said antenna are disposed substantially perpendicularly to one another.

6. The hearing aid apparatus according to claim 1, further comprising a battery and said antenna is coupled to said battery functioning as a signaling counterweight.

7. The hearing aid apparatus according to claim 1, wherein:

said housing has a metalized housing face; and said antenna is coupled to said metallized housing face of said housing.

8. The hearing aid apparatus according to claim 1, further comprising a battery, said antenna is coupled by means of at least one of said contact arms to said battery functioning as a signaling counterweight.

9. The hearing aid apparatus according to claim 1, wherein:

said housing has a metalized housing face; and said antenna is coupled to said metallized housing face by means of at least one of said contact arms.

10. The hearing aid apparatus according to claim 3, wherein said grip element is a pull-out thread.

11. A hearing aid device, comprising:

two hearing aid apparatuses, each of said hearing aid apparatuses containing:

a housing having a housing face, said housing face being directed outwardly when said hearing aid apparatuses are being worn;

an antenna being an F-shaped antenna having two contact arms disposed inside said housing as horizontal F limbs;

a transmitter and/or receiver for electromagnetic waves and disposed in said housing, said transmitter and/or receiver coupled to said antenna;

a grip element disposed on said housing face of said housing, and said antenna is integrated at least in part in said grip element; and a transmitting and/or receiving region integrated in said grip element as a vertical F limb, said vertical F limb is coupled to said two contact arm; and said hearing aid apparatuses are wirelessly connected to one another by means of said antenna thereof for signal exchange.

* * * * *